United States Patent [19]

Contois et al.

[11] 3,966,468

[45] June 29, 1976

[54] ORGANIC PHOTOCONDUCTORS WITH TRIAMINO BENZENE ADDITIVES

[75] Inventors: Lawrence E. Contois; Norman G. Rule, both of Webster, N.Y.

[73] Assignee: Eastman Kodak Company, Rochester, N.Y.

[22] Filed: Apr. 25, 1975

[21] Appl. No.: 571,469

[52] U.S. Cl. ..... 96/1.5; 96/1.6

[51] Int. Cl.[2] ..... G03G 5/06

[58] Field of Search ..... 96/1.5, 1.6

[56] References Cited

UNITED STATES PATENTS

| | | | |
|---|---|---|---|
| 3,850,630 | 11/1974 | Rogensburger et al. | 96/1.5 |
| 3,877,935 | 4/1975 | Rogensburger et al. | 96/1.5 |
| 3,879,200 | 4/1975 | Rogensburger et al. | 96/1.5 |

OTHER PUBLICATIONS

Hoegl, "On Photoelectric Effects in Polymers and Their Sensitization by Dopants," Jour. Phys. Chem., vol. 69 No. 3, Mar. 1965, pp. 756–766.

Meier et al., "Doping Organic Photoconductors," Zeit. Fur Phys. Chem., Neue Folge, 39, 1963, pp. 249–261.

*Primary Examiner*—Roland E. Martin, Jr.

*Attorney, Agent, or Firm*—D. M. DeLeo

[57] ABSTRACT

In organic, photoconductive insulating compositions including one or more organic photoconductors, the image contrast characteristics obtained when using such compositions can be modified or modifiable when the composition includes a triaminobenzene compound, such as one having the formula

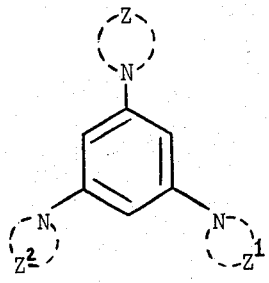

wherein each of Z, $Z^1$ and $Z^2$, taken together with the nitrogen to which each is attached, represents the non-metallic atoms necessary to complete a heterocyclic group having from 5 to 10 atoms in the cyclic nucleus.

16 Claims, No Drawings

ORGANIC PHOTOCONDUCTORS WITH TRIAMINO BENZENE ADDITIVES

BACKGROUND OF THE INVENTION

1. Field of the Invention

This invention relates to electrophotography and in particular to photoconductive insulating compositions and elements, and to processes using such compositions and elements.

2. Description of the Prior Art

The process of xerography, as disclosed by Carlson in U.S. Pat. No. 2,297,691, employs an electrophotographic element comprising a support material bearing a coating of an insulating material whose electrical resistance varies with the amount of incident electromagentic radiation it receives, such as during an image-wise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge of electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Various photoconductive insulating materials have been employed in the manufacture of electrophotographic elements. For example, vapors of selenium and vapors of selenium alloys deposited on a suitable support and particles of photoconductive zinc oxide held in a resinous, film-forming binder bave found wide application in present-day document-copying processes.

Since the introduction of electrophotography, a great many organic compounds have also been screened for their photoconductive properties. As a result, a very large number of organic compounds have been known to possess some degree of photoconductivity. Many organic compounds have revealed a useful level of photoconduction and have been incorporated into photoconductive compositions. Among these organic photoconductors are certain of the triphenylamines as described in U.S. Pat. No. 3,180,730 issued Apr. 27, 1965, and the polyarylalkane compounds such as those described in U.S. Pat. No. 3,274,000 issued Sept. 20, 1966; U.S. Pat. No. 3,542,547 issued Nov. 24, 1974; and in U.S. Pat. No. 3,615,402 issued Oct. 26, 1971. Other useful photoconductors include high speed "heterogeneous" or "aggregate" multiphase photoconductive compositions, such as those described in U.S. Pat. No. 3,615,414 issued Oct. 26, 1971.

It is often desirable to modify the imaging parameters of photoconductive insulating compositions. One such parameter is image contrast, which refers broadly to the relationship between the intensity of the electrophotographic image (i.e. its charge magnitude or optical density, if developed) and the exposure range typically used to promote imagewise discriminations. High contrast photoconductive compositions generally produce more substantial variations in charge or optical density over a particular range of imaging exposure intensity than do low contrast compositions. Depending on use, it can be desirable to have a composition that exhibits either high or low contrast imaging characteristics. For example, when reproducing continuous tone images, lower contrast compositions are usually preferred because they have greater ability to reproduce subtle gradations of image detail. However, in some cases higher contrast may be desired to provide a copy that accentuates detail within a particular density range of the original or any portion of the original. Such copies can be useful for interpretation of aerial photographs.

SUMMARY OF THE INVENTION

The present invention provides organic photoconductive insulating compositions that exhibit modified or modifiable contrast characteristics, as compared to the contrast characteristics of similar photoconductive insulating compositions, but without a contrast modifying agent as described in detail hereinafter. Compositions of this invention include an organic photoconductor and a triaminobenzene compound as a contrast modifying agent. Desirable triaminobenzenes include those represented by the formula

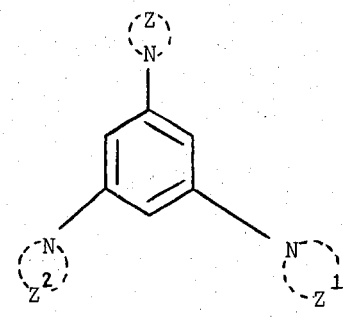

wherein each of Z, $Z^1$ and $Z^2$, which can be the same or different, taken together with the nitrogen to which each is attached, represents the non-metallic atoms necessary to complete a heterocyclic group having from 5 to 10 atoms in a mono- or polycyclic nucleus. Such compositions can be coated on electrically conducting supports to provide electrophotographic elements on which can be formed electrostatic charge patterns and visible images, as is described in detail below.

In one embodiment of the present invention, contrast-modifying agents of the type described herein can be used to advantage in the continuous phase of multiphase aggregate photoconductive compositions. It has been discovered that, depending on the polarity to which the photoconductive insulating layer of the element is charged prior to imaging, images of different relative contrast can be prepared using electrophotographic elements that contain photoconductive compositions of this invention including an aggregate species as a photoconductor. In another embodiment of the invention, such contrast-modifying agents can be used in homogeneous, non-aggregate photoconductive compositions to reduce image contrast and provide additional exposure latitude. Still further, aggregate photoconductive compositions using such contrast-modifying agents can exhibit persistent conductivity, which can be useful for making multiple copies without repeating the initial imaging exposure. Such contrast modification can be accomplished conveniently, without specialized apparatus or elaborate image-forming procedures.

DESCRIPTION OF THE PREFERRED EMBODIMENTS

The organic photoconductive insulating compositions of this invention include, as contrast-modifying agents or contrast control agents, triaminobenzenes such as one or more compounds of formula I, namely,

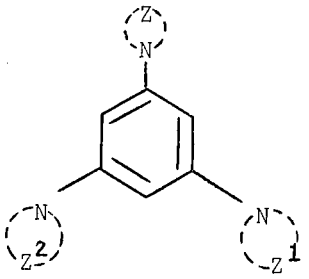

wherein, as described previously, each of Z, $Z^1$ and $Z^2$, taken together with the respective nitrogen to which each is attached, represents the non-metallic atoms necessary to complete a heterocyclic group having from 5 to 10 atoms in the cyclic nucleus which can be monocyclic or polycyclic. These heterocyclic groups can be the same or different and exemplary such groups include pyrrolyl, pyridyl, indolyl, quinolyl, pyrrolinyl, piperidino and the like. In a preferred embodiment, each of the described groups is a saturated heterocyclic group having 5 or 6 atoms in a monocyclic nucleus, e.g. pyrrolinyl or piperidino. In one highly preferred embodiment, each of the groups is a piperidino group.

The groups completed by atoms represented by Z, $Z^1$ and $Z^2$ can be unsubstituted or they can be substituted with widely varying groups. In each case, the usefulness as a contrast-modifying agent of substituted compounds according to formula I can be determined conveniently by means of the test described hereinafter. A particularly useful class of substituents is alkyl groups, especially lower alkyl groups containing from 1 to about 4 carbon atoms in the chain used as a basis for naming the particular group. Compounds according to formula I can be prepared conveniently using, for example, the method of F. Effenberger as described in *Chemische Berichte*, Vol. 103, No. 5, p. 1451 (1970).

As mentioned previously, contrast-modifying agents described herein are used to advantage in organic photoconductive insulating compositions that include at least one organic photoconductor, in addition to the contrast-modifying agent. The term "organic," as used herein, refers both to organic and metallo-organic materials. In one embodiment, the contrast-modifying agents can be used in organic, aggregate photoconductive, insulating compositions. Such compositions comprise an organic sensitizing dye and at least one electrically insulating, film-forming polymeric material. They may be prepared by several techniques, such as, for example, the so-called "dye first" technique described in Gramza et al. U.S. Pat. No. 3,615,396 issued Oct. 26, 1971. Alternatively, they may be prepared by the so-called "shearing" method described in Gramza, U.S. Pat. No. 3,615,415 issued Oct. 26, 1971. This latter method involves the high speed shearing of the photoconductive composition prior to coating and thus eliminates subsequent solvent treatment, as was disclosed in Light, U.S. Pat. No. 3,615,414 referred to above. By whatever method prepared, the aggregate composition is combined with at least one contrast-modifying agent in a suitable solvent to form a photoconductor-containing composition which is coated on an electrically conducting support to form a separately identifiable multiphase composition, the heterogeneous nature of which is generally apparent when viewed under magnification, although such compositions may appear to be substantially optically clear to the naked eye in the absence of magnification. There can, of course, be macroscopic heterogeneity. Suitably, the dye-containing aggregate in the discontinuous phase is predominantly in the size range of from about 0.01 to about 25 microns.

In general, the aggregate compositions formed as described herein are multiphase organic solids containing dye and polymer. The polymer forms an amorphous matrix or continuous phase which contains a discrete discontinuous phase as distinguished from a solution. The discontinuous phase is the aggregate species which is a co-crystalline complex comprised of dye and polymer. The contrast control agent is usually dissolved in the continuous phase.

The term co-crystalline complex as used herein has reference to a crystalline compound which contains dye and polymer molecules co-crystallized in a single crystalline structure to form a regular array of the molecules in a three-dimensional pattern.

Another feature characteristic of the aggregate compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm. If mixtures of dyes are used, one dye may cause an absorption maximum shift to a shorter wavelength. In such cases, a formation of the aggregate compositions can more easily be identified by viewing under magnification.

Sensitizing dyes and electrically insulating polymeric materials are used in forming these aggregate compositions. Typically, pyrylium dyes, including pyrylium, bispyrylium, thiapyrylium and selenapyrylium dye salts and also salts of pyrylium compounds containing condensed ring systems such as salts of benzopyrylium and naphthopyrylium dyes are useful in forming such compositions. Dyes from these classes which may be useful are disclosed in Light U.S. Pat. No. 3,615,414.

Particularly useful dyes in forming the feature aggregates are pyrylium dye salts having the formula:

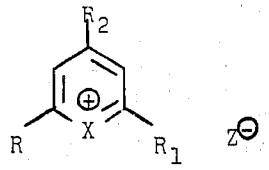

wherein:

R and $R_1$ can each be phenyl groups, including substituted phenyl groups having at least one substituent chosen from alkyl groups of from 1 to about 6 carbon atoms;

$R_2$ can be an alkylamino-substituted phenyl group having from 1 to 6 carbon atoms in the alkyl group, and including dialkylamino-substituted and haloalkylamino-substituted phenyl groups;

X can be an oxygen, selenium or a sulfur atom; and $Z^{\ominus}$ is an anion.

The polymers useful in forming the aggregate compositions include a variety of materials. Particularly useful are electrically insulating, film-forming polymers having an alkylidene diarylene group in a recurring unit such as those linear polymers, including copolymers, containing the following group in a recurring unit:

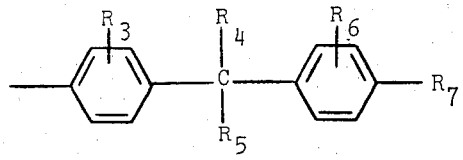

wherein:

$R_4$ and $R_5$, when taken separately, can each be a hydrogen atom, an alkyl group having from one to about 10 carbon atoms such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_4$ and $R_5$, when taken together, can represent the carbon atoms necessary to complete a saturated cyclic hydrocarbon group including cycloalkanes such as cyclohexyl and polycycloalkanes such as norbornyl, the total number of carbon atoms in $R_4$ and $R_5$ being up to about 19;

$R_3$ and $R_6$ can each be hydrogen, an alkyl group of from 1 to about 5 carbon atoms, e.g., or a halogen such as chloro, bromo, iodo, etc.; and $R_7$ is a divalent group selected from the following:

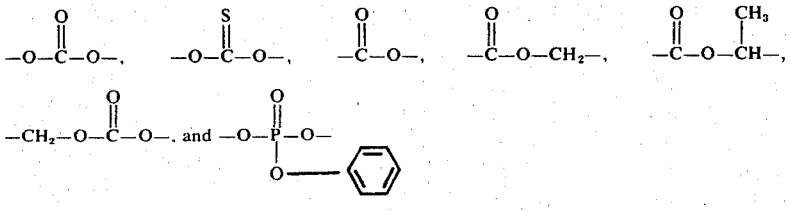

Preferred polymers useful for forming aggregate crystals are hydrophobic carbonate polymers containing the following group in a recurring unit:

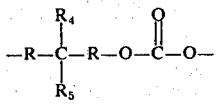

wherein:

each R is a phenylene group including halo-substituted phenylene groups and alkyl-substituted phenylene groups; and $R_4$ and $R_5$ are described above. Such compositions are disclosed, for example in U.S. Pat. Nos. 3,028,365 and 3,317,466. Preferably polycarbonates containing an alkylidene diarylene group in the recurring unit such as those prepared with Bisphenol A and including polymeric products of ester exchange between diphenylcarbonate and 2,2-bis-(4-hydroxyphenyl) propane are useful in the practice of this invention. Such compositions are disclosed in the following U.S. Pat. Nos. 2,999,750 by Miller et al, issue Sept. 12, 1961; 3,038,874 by Laakso et al, issued June 12, 1962; 3,038,879 by Laakso et al, issued June 12, 1962; 3,038,880 by Laakso et al, issued June 12, 1962; 3,106,544 by Laakso et al, issued Oct. 8, 1963; 3,106,545 by Laakso et al, issued Oct. 8, 1963; and 3,106,546 by Laakso et al, issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers are included among the materials useful in the practice of this invention:

Table 2

| No. | Polymeric Material |
|---|---|
| 1 | poly(4,4'-isopropylidenediphenylene-co-1,4-cyclohexylenedimethylene carbonate) |
| 2 | poly(ethylenedioxy-3,3'-phenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenediphenylene thiocarbonate) |
| 6 | poly(4,4'-sec-butylidenediphenylene carbonate) |
| 7 | poly(4,4'-isopropylidenediphenylene carbonate-block-oxyethylene) |
| 8 | poly(4,4'-isopropylidenediphenylene carbonate-block-oxytetramethylene) |
| 9 | poly [4,4'-isopropylidenebis(2-methylphenylene)-carbonate] |
| 10 | poly(4,4'-isopropylidenediphenylene-co-1,4-phenylene carbonate) |
| 11 | poly(4,4'-isopropylidenediphenylene-co-1,3-phenylene carbonate) |
| 12 | poly(4,4'-isopropylidenediphenylene-co-4,4'-diphenylene carbonate) |
| 13 | poly(4,4'-isopropylidenediphenylene-co-4,4'-oxydiphenylene carbonate) |
| 14 | poly(4,4'-isopropylidenediphenylene-co 4,4'-carbonyldiphenylene carbonate) |
| 15 | poly(4,4'-isopropylidenediphenylene-co-4,4'-ethylenediphenylene carbonate) |
| 16 | poly [4,4'-methylenebis(2-methyl- |

Table 2-continued

| No. | Polymeric Material |
|---|---|
| | phenylene)carbonate] |
| 17 | poly [1,1-(p-bromophenylethylidene)bis(1,4-phenylene)carbonate] |
| 18 | poly [4,4'-isopropylidenediphenylene-co-4,4'-sulfonyldiphenylene)carbonate] |
| 19 | poly [4,4'-cyclohexylidene(4-diphenylene carbonate] |
| 20 | poly [4,4'-isopropylidenebis(2,chlorophenyl)-ene)carbonate] |
| 21 | poly(4,4'-hexafluoroisopropylidenediphenylene carbonate) |
| 22 | poly(4,4'-isopropylidenediphenylene 4,4'-isopropylidenedibenzoate) |
| 23 | poly(4,4'-isopropylidenedibenzyl 4,4'-isopropylidenedibenzoate) |
| 24 | poly [4,4'-(1,2-dimethylpropylidene)diphenylene carbonate] |
| 25 | poly [4,4'-(1,2,2-trimethylpropylidene)-diphenylene carbonate] |
| 26 | poly {4,4'- [1-( -napthyl)ethylidene]-diphenylene carbonate} |
| 27 | poly [4,4'-(1,3-dimethylbutylidene)-diphenylene carbonate] |
| 28 | poly [4,4'-(2-norbornylidene)diphenylene carbonate] |
| 29 | poly [4,4'-(hexahydro-4,7-methanoindan-5-ylidene) diphenylene carbonate] |

Electrophotographic elements of the invention containing an aggregate photoconductive composition can be prepared by blending a dispersion or solution of the photoconductor together with a binder containing a contrast-modifying agent dissolved in the binder, and coating or forming a self-supporting layer with the composition. The triaminobenzene contrast-modifying agents are typically included in aggregate photoconductive compositions in an amount of about from 10 to about 50% by weight, based on the total weight of the composition. Still wider ranges can be useful for many purposes. Supplemental materials useful for changing the spectral sensitivity or electrophotosensitivity of the element can be added to the composition of the element when it is desirable to produce the characteristic effect of such materials. If desired, other polymers can be incorporated in the vehicle, for example, to alter physical properties such as adhesion of the photoconductive layer to the support and the like. Techniques for the preparation of aggregate photoconductive layers containing such additional vehicles are described in C. L. Stephens, U.S. Pat. No. 3,679,407 issued July 25, 1972, and entitled METHOD OF FORMING HETEROGENEOUS PHOTOCONDUCTIVE COMPOSITONS AND ELEMENTS. The photoconductive layers of the invention can also be sensitized by the addition of effective amounts of sensitizing compounds to exhibit improved electrophotosensitivity.

Other photoconductive materials, such as those described herein, can be used together with the aggregate species. The amount of non-aggregate photoconductor desirably incorporated into the aggregate photoconductive compositions and elements of the invention can be varied over a relatively wide range. When used in an aggregate photoconductive composition, such non-aggregate photoconductors are preferably in the continuous phase of the aggregate composition and may be present in an amount within the range of from about 1.0 to about 60.0 percent by weight (based on the dry weight of the aggregate photoconductive composition). Larger or smaller amounts of non-aggregate photoconductors may also be employed in aggregate photoconductive compositions although best results are generally obtained when using an amount within the aforementioned range.

In addition to electrographic elements containing the above-described aggregate photoconductive insulating compositions there are other useful embodiments of the present invention. For example, "non-aggregate-containing" electrographic elements can be prepared in the usual manner with photoconductors other than aggregate materials, i.e., by blending a dispersion or solution of a photoconductive compound together with a contrast-modifying agent and a binder, when necessary or desirable, and coating or forming a self-supporting layer with the photoconductor-containing materials. Exemplary non-aggregate photoconductors include:

a. Arylamine photoconductors including substituted and unsubstituted arylamines, diarylamines, nonpolymeric triarylamines and polymeric triarylamines such as those described in Fox U.S. Pat. No. 3,240,597 issued Mar. 15, 1966 and Klupfel et al, U.S. Pat. No. 3,180,730 issued Apr. 27, 1965.

b. Polyarylalkane photoconductors of the types described in Noe et al U.S. Pat. No. 3,274,000 issued Sept. 20, 1966, Wilson U.S. Pat. No. 3,542,547 issued Nov. 24, 1970; Seus et al. U.S. Pat. No. 3,542,544 issued Nov. 24, 1970; and in Rule U.S. Pat. No. 3,615,402 issued Oct. 26, 1971;

c. Diarylamino-substituted chalcones of the types described in Fox U.S. Pat. No. 3,526,501 issued Sept. 1, 1970.

d. Non-ionic cycloheptenyl compounds of the types described in Looker U.S. Pat. No. 3,533,786 issued Oct. 13, 1970;

e. Compounds containing an <N—N> nucleus, as described in Fox U.S. Pat. No. 3,542,546 issued Nov. 24, 1970;

f. Organic compounds having a 3,3'bis-aryl-2-pyrazoline nucleus, as described in Fox et al. U.S. Pat. No. 3,527,602 issued Sept. 8, 1970;

g. Triarylamines in which at least one of the aryl radicals is substituted by either a vinyl radical or a vinylene radical having at least one active-hydrogen-containing group, as described in Brantly et al. U.S. Pat. No. 3,567,450 issued Mar. 2, 1971;

h. Triarylamines in which at least one of the aryl radicals is substituted by an active-hydrogen-containing group, as described in Brantly et al. Belgian Pat. No. 728,563 dated Apr. 30, 1969;

i. Organo-metallic compounds having at least one aminoaryl substituent attached to a Group IVa or Group Va metal atom, as described in Goldman et al. Canadian Pat. No. 818,539 dated July 22, 1969;

j. Organo-metallic compounds having at least one amino-aryl substituent attached to a Group IIIa metal atom, as described in Johnson Belgian Pat. No. 735,334 dated Aug. 29, 1969;

k. Charge-transfer combinations, e.g. those comprising a photoconductor and a Lewis acid, as well as photoconductive compositions involving complexes of nonphotoconductive material and a Lewis acid, such as described, for example, in Jones U.S. Defensive Publication T881,002 dated Dec. 1, 1970 and Mammino U.S. Pat. Nos. 3,408,181 through 3,408,190 all dated Oct. 29, 1968 and Inami et al. U.S. Pat. No. 3,418,116 dated Dec. 24, 1968.

Other types of organic photocondutors include azourethanes; heterocyclic compounds such as carbazoles, oxazoles, benzothiazoles, imidazoles, tetrazacyclooctatetraenes etc; aromatic hydrocarbons such as acenaphthene, anthracene, phenanthrene etc, as well as polymers containing the same aromatic nitro compounds such as 2,4,7-trinitrofluoren-9-one, trinitrobenzene, etc; ketonic compounds such as benzil, chloranil, benzophenone, etc; polymeric materials such as polyvinylcarbazole and halogenated counterparts, polymers of formaldehyde and aromatic hydrocarbons, etc, as well as mixtures of such materials with Lewis acids; pigments such as phthalocyanine; dyes such as Rhodamine B, crystal violet, etc; and many others. In addition, supplemental materials useful for changing the spectral sensitivity or electrophotosensitivity of the element can be added to the composition of the element when it is desirable to produce the characteristic effect of such materials.

The non-aggregate, organic photoconductive insulating layers of the invention such as homogeneous organic photoconductive compositions can be sensitized by the addition of effective amounts of sensitizing compounds to exhibit improved electrophotosensitivity. Sensitizing compounds useful with the photoconductive compounds of the present invention can be selected from a wide variety of materials, including such materials as pyrylium dye salts including thiapyrylium dye materials and selenapyrylium dye salts disclosed in VanAllan et al U.S. Pat. No. 3,250,615; fluorenes, such as 7,12-dioxo-13-dibenzo(a,h)fluorene, 5,10-dioxo-4a, 11-diazobenzo(b)-fluroene, 3,13-dioxo-7-oxadibenzo (b,g)fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 3,732,301; mineral acids; carboxylic acids, such as maleic acid, dichloroacetic acid, trichloroacetic acid and salicylic acid, sulfonic and phosphoric acids, and various dyes, such as cyanine (including carbocyanine), merocyanine, diarylmethane, thiazine, azine, oxazine, xanthene, phthalein, acridine, azo, anthraquinone dyes and the like and mixtures thereof. The sensitizers preferred for use with the compounds of this invention are selected from pyrylium salts including selenapyrylium salts and thiapyrylium salts, and cyanine dyes including carbocyanine dyes.

Where a sensitizing compound is employed with the binder and organic photoconductor to form a sensitized, non-aggregate-containing organic photoconductive composition, it is the normal practice to mix a suitable amount of the sensitizing compound with the coating composition so that, after thorough mixing, the sensitizing compound is uniformly distributed in the coated layer.

Other methods of incorporating the sensitizer may, however, be employed consistent with the practice of this invention. In preparing the non-aggregate organic photoconductive layers, no sensitizing compound is required in the layers which contain the photoconducting substances to give photoconductivity with respect to ultraviolet radiation sources; therefore, a sensitizer may not be required in a particular photoconductive layer of the invention depending upon the particular radiation source selected. However, since relatively minor amounts of sensitizer are effective in (a) producing a layer exhibiting photoconductivity with respect to visible light and (b) substantially increasing the electrical speed of the layer, the use of a sensitizer is generally preferred. The amount of sensitizer that can be added to a photoconductor-incorporating layer to give effective increases in speed can vary widely. The optimum concentration in any given case will vary with the specific photoconductor and sensitizing compound used. In general, substantial speed gains can be obtained where an appropriate sensitizer is added in a concentration range from about 0.001 to about 30 percent by weight based on the weight of the film-forming coating composition, with an amount of from about 0.005 to about 10 percent by weight being typical.

Preferred binders for use in preparing the present non-aggregate organic photoconductive layers are film-forming, hydrophobic polymeric binders having fairly high dielectric strength and good electrical insulating properties.

Typical of these materials are:

I. Natural resins including gelatin, cellulose ester derivatives such as alkyl esters of carboxylated cellulose, hydroxy ethyl cellulose, carboxy methyl cellulose, carboxy methyl hydroxy ethyl cellulose, etc.;

II. Vinyl resins including
   a. polyvinyl esters such as a vinyl acetate resin, a copolymer of vinyl acetate and crotonic acid, a copolymer of vinyl acetate with an ester of vinyl alcohol and a higher aliphatic carboxylic acid such as lauric acid or stearic acid, polyvinyl stearate, a copolymer of vinyl acetate and maleic acid, a poly(vinylhaloarylate) such as poly(vinyl-m-bromobenzoate-covinyl acetate), a terpolymer of vinyl butyral with vinyl alcohol and vinyl acetate, etc.;
   b. vinyl chloride and vinylidene chloride polymers such as a poly(vinylchloride), a copolymer of vinyl chloride and vinyl isobutyl ether, a copolymer of vinylidene chloride and acrylonitrile, a terpolymer if vinyl chloride, vinyl acetate and vinyl alcohol, poly(vinylidene chloride) a terpolymer of vinyl chloride, vinyl acetate and maleic anhydride, a copolymer of vinyl chloride and vinyl acetate, etc.;
   c. styrene polymers such as polystyrene, a nitrated polystyrene, a copolymer of styrene and monoisobutyl maleate, a copolymer of styrene with methacrylic acid, a copolymer of styrene and butadiene, a copolymer of dimethylitaconate and styrene, polymethylstyrene, etc.;
   d. methacrylic acid ester polymers such as a poly(alkylmethacrylate), etc.;
   e. polyolefins such as chlorinated polyethylene, chlorinated polypropylene, poly(isobutylene), etc.;
   f. poly(vinyl acetals) such as poly(vinyl butyral, etc.; and
   g. poly(vinyl alcohol);

III. Polycondensates including
   a. a polyester or 1,3-disulfobenzene and 2,2-bis(4-hydroxyphenyl)propane;
   b. a polyester of diphenyl-p,p′-disulphonic acid and 2,2-bis(4-hydroxyphenyl)propane;
   c. a polyester of 4,4′-dicarboxyphenyl ether and 2,2-bis(4-hydroxyphenyl)propane;
   d. a polyester of 2,2-bis(4-hydroxyphenyl)-propane and fumaric acid;
   e. polyester of pentaerythritol and phthalic acid;

f. resinous terpene polybasic acid;
g. a polyester of phosphoric acid and hydroquinone;
h. polyphosphites;
i. polyester of neopentylglycol and isophthalic acid;
j. polycarbonates including polythiocarbonates such as the polycarbonate of 2,2-bis(4-hydroxyphenyl)-propane;
k. polyester of isophthalic acid, 2,2-bis[4-(β-hydroxyethoxy)phenyl]propane and ethylene glycol;
l. polyester of terephthalic acid, 2,2-bis[4-(β-hydroxyethoxy)phenyl]propane and ethylene glycol;
m. polyester of ethylene glycol, neopentyl glycol, terephthalic acid and isophthalic acid;
n. polyamines;
o. ketone resins; and
p. phenol-formaldehyde resins;

IV. Silicone resins;
V. Alkyd resins including styrene-alkyd resins, silicone-alkyd resins, soya-alkyd resins, etc.;
VI. Polyamides;
VII. Paraffin; and
VIII. Mineral waxes.

Solvents useful for preparing coating compositions containing the photoconductors of the present invention can include a wide variety of organic solvents for the components of the coating composition.

Typical solvents include:

1. Aromatic hydrocarbon such as benzene, naphthalene, etc., including substituted aromatic hydrocarbons such as toluene, xylene, mesitylene, etc.;
2. Ketones such as acetone, 2-butanone, etc.;
3. Halogenated aliphatic hydrocarbons such as methylene chloride, chloroform, ethylene chloride, etc.;
4. Ethers including cyclic ethers such as tetrahydrofuran, ethyl ether;
5. Mixtures of the above.

In preparing non-aggregate-containing photoconductive coating compositions of the present invention useful results are obtained where the photoconductor is present in an amount equal to at least about 1.0 percent of the composition. Typically, the photoconductive compound is present in an amount equal to at least about 15 percent by weight of the resultant photoconductive composition. The upper limit in the amount of photoconductive material present in the non-aggregate conductive material present in the non-aggregate photoconductive composition of the invention can be widely varied to at least 90% by weight in accordance with usual practice. The triaminobenzene contrast modifying agents are desirably present in the photoconductive composition in an amount of from about 1% to about 10–15% by weight based on the total composition, although more widely varying amounts can be used if desired. For aggregate and non-aggregate photoconductive compositions the contrast-modifying agent as generally in the composition in an amount of from about 5% by weight to about 50% by weight, based on the weight of the photoconductor.

Suitable supporting materials on which both the aggregate and non-aggregate photoconductive insulating layers of this invention can be coated include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor-deposited metal layers such as silver, nickel, aluminum and the like coated on paper or conventional photographic film bases such as cellulose acetate, polystyrene, etc. Such conducting materials as nickel can be vacuum-deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk issued Nov. 7, 1961, and 3,262,807 by Sterman et al., issued July 26, 1966.

Coating thicknesses of both the aggregate and nonaggregate photoconductive composition of the invention on a suitable support can vary widely. Normally, a coating in the range of about 10 mirons to about 300 microns before drying is useful for the practice of this invention. The preferred range of coating thickness is found to be in the range from about 50 microns to about 150 microns before drying, although useful rsults can be obtained outside of this range. The resultant dry thickness of the coating is preferably between about 2 microns and about 50 microns, although useful results can be obtained with a dry coating thickness between about 1 and about 200 microns.

Photoconductive elements according to the present invention can be employed in any of the well-known electrophotographic processes which require photoconductive layers. One such process is the xerographic process. In a process of this type, an electrophotographic element is held in the dark and given a blanket electrostatic charge by placing it under a corona discharge. This uniform is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light-struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically-responsive particles having optical density. The developing electrostatically-responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young issued Mar. 26, 1957; 2,786,440 by Giaimo issued Mar. 26, 1957; 2,786,441 by Young issued Mar. 26, 1957; 2,874,063 by Grieg issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al. issued Oct. 6, 1959. In dry developing processes, the most widely used method of obtaining a permanent record is achieved by selecting a developing particle which has as one of its components a low-melting resin. Heating the powder image causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review" Vol. 15 (1954) pages 469–484.

The electrical resistivity of the photoconductive insulating element of the invention (as measured across the photoconductive insulating composition of the element in the absence of activating radiation for the composition) should be at least about $10^9$ ohm-cms. at 25°C. In general, it is advantageous to use elements having a resistivity several orders of magnitude higher than $10^{10}$ ohm-cms., for example, elements having an electrical resistivity greater than about $10^{14}$ ohm-cms. at 25°C.

Determination of the contrast-modifying potential of a triaminobenzene compound can be accomplished conveniently. For such purposes, an aggregate photoconductive composition as described in Example 1 herein can be used as a control reference. To prepare a test composition, the control can be modified by the addition of 30% by weight of the triaminobenzene compound under evaluation. Equivalent control and test electrographic elements using the control and test compositions, can then be prepared by conventional techniques as described herein. Such completed control and test elements can then be compared by charging each to an initial voltage of the same polarity, giving each charged element an equal sensitometric exposure and thereafter determining the relative speed and relative average contrast as explained below. The relative speed and relative average contrast of control and test elements should be determined after charging to the same voltage of both positive and negative polarity. If the triaminobenzene compound under evaluation is a contrast-modifying agent, then for the aggregate photoconductive element, the difference between relative average contrast as measured from an initial charge of negative polarity and relative average contrast as measured from an initial charge of positive polarity will be greater than the difference in similar measurements made with respect to the control element.

In the case of aggregate-free photoconductive compositions, such as one containing 25% by weight of a polyarylmethane photoconductor and 5% by weight of a triaminobenzene under evaluation, similar preparation of elements and testing may provide equivalent results, or it may provide an overall lower relative contrast combined with a lower differential contrast.

The relative speed measurements reported herein, such as in the following examples, are relative H & D electrical speeds. The relative H & D electrical speeds measure the speed of a given photoconductive material relative to other materials typically within the same test group of materials. The relative speed values are not absolute speed values. However, relative speed values are related to absolute speed values. The relative electrical speed (shoulder or toe speed) is obtained simply by arbitrarily assigning a value, Ro, to one particular absolute shoulder or toe speed of one particular photoconductive material. The relative shoulder or toe speed, $Rn$, of any other photoconductive material, n, relative to this value $Ro$, may then be calculated as follows: $Rn = (A_n/A_o)\ (Ro)$ wherein $A_n$ is the absolute electrical speed of material $n$, $Ro$ is the speed value arbitrarily assigned to the first material, and $A_o$ is the absolute electrical speed of the first material. The absolute H & D electrical speed, either the shoulder (SH) or toe speed, of a material may be determined as follows: The material is electrostatically charged under, for example, a corona source until the surface potential, as measured by an electrometer probe, reaches some suitable initial value $V_o$, typically about 600 volts. The charged element is then exposed to a 3000°K tungsten light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface to any fixed selected value. An apparatus useful for determining the electrophotographic speeds of photoconductive compositions is described in Robinson et al, U.S. Pat. No. 3,449,658 issued June 10, 1969.

The relative average contrast for either positive or negative charging is the reciprocal of the difference in the logarithm of the shoulder speed and that of the toe speed as follows:

$$\text{Relative Average Contrast} = \frac{1}{\text{log shoulder speed} - \text{log toe speed}}$$

The following examples are included to illustrate the present invention:

EXAMPLE 1

An aggregate photoconductive insulating composition was prepared by the two-stage dye first technique described in U.S. Pat. No. 3,679,408, using a 9.0 weight percent dichloromethane solution of polycarbonate (sold as Lexan 145 by General Electric) in combination with a dye including an 85:15 weight ratio of 4-(4-dimethylaminophenyl)-2,6-diphenylthiapyrylium fluoroborate and 4-(4-dimethylaminophenyl)-2-(4-ethoxyphenyl)-6-phenylthiapyrylium fluoroborate in sufficient quantity to yield a dye level of 3% based on the total weight of the composition. To four portions of the resultant composition were added as follows:

| | |
|---|---|
| A (control) | 4,4'-bis(diethylamino)-2,2'-dimethyltriphenylmethane (30% by weight) |
| B | 1,3,5-tripiperidinobenzene (20% by weight) |
| C | 1,3,5-tripiperidinobenzene (30% by weight) |
| D | 1,3,5-tripiperidinobenzene (40% by weight) |

The compositions A–D above were coated on poly(ethylene terephthalate) support overcoated with a evaporated nickel conductive layer and dried to form corresponding electrophotographic elements A–D. Each of these elements was uniformly charged to both a positive and a negative potential of volts and was exposed sensitometrically to a 3,000°K tungstenlight through a stepped density grey scale. The resultant Relative Electrical H and D Speed and Relative Average Contrast were then determined as described above. Such speed and contrast values, as well as Contrast Differential are summarized as follows:

| Element | Relative Electrical H and D Speed $V_o$-100 Sh/100V Toe (+) | (−) | Relative Average Contrast (+) | (−) | Contrast Differential |
|---|---|---|---|---|---|
| 1A (control) | 1176/170 | 470/100* | 1.20 | 1.50 | 0.30 |
| 1B | 64/9 | 135/61 | 1.19 | 2.94 | 1.75 |
| 1C | 94/9 | 147/88 | 1.00 | 4.51 | 3.51 |
| 1D | 70/7 | 141/88 | 1.00 | 4.90 | 3.90 |

*Assigned a value of 100

Contrast values for elements 1B–1D, as compared to those obtained with element 1A, illustrate the substantial contrast modification obtained using aggregate photoconductive compositions including contrast modifiers described herein.

EXAMPLE 2

An aggregate photoconductive insulating composition was prepared as described in Example 1. To four portions (2A–2D) of this composition were added the control photoconductor of Example 1, alone or in combination with a contrast-modifying agent as follows:

| | Photoconductor | Contrast Modifying Agent |
|---|---|---|
| 2A | 40% | 0 |
| 2B | 30% | 10 |
| 2C | 50% | 0 |
| 2D | 40% | 10 |

(Quantities are percent by weight, based on the total composition)

Elctrophotographic elements using compositions 2A–2D were prepared and tested as described in Example 1 with the following results:

| Element | Relative Electrical H and D Speed ($V_o$-100 Sh/100V Toe) (+) | (−) | Relative Average Contrast (+) | (−) | Contrast Differential |
|---|---|---|---|---|---|
| 2A | 1000/138 | 379/100* | 1.16 | 1.34 | 0.18 |
| 2B | 172/21 | 182/79 | 1.11 | 2.76 | 1.65 |
| 2C | 1000/155 | 482/134 | 1.54 | 1.80 | 0.26 |
| 2D | 379/26 | 196/96 | 0.86 | 3.23 | 2.37 |

assigned a value of 100

As indicated by the data, minor amounts of the contrast-modifying agent can have a dramatic affect on the contrast of mixed photoconductor elements.

EXAMPLE 3

An aggregate photoconductive insulating composition was prepared as described in Example 1. To four portions (3A–3D) of this composition were added a photoconductor (polyarylmethane type or polyarylamine type), alone or in combination with 1,3,5-tripiperidinobenzene as a contrast-modifying agent as follows:

| | Photoconductor | Contrast Modifying Agent |
|---|---|---|
| 3A | 4,4'-Bis(diethylamino)tetraphenylmethane (40%) | 0 |
| 3B | As A, but 30% | 10% |
| 3C | Tri-p-tolylamine (40%) | 0 |
| 3D | As C, but 30% | 10% |

(Quantities are percent by weight, based on the total composition)

Electrophotographic elements using the compositions 3A–3D were prepared and tested as described in Example 1, with the following results:

| Element | Relative Electrical H and D Speed ($V_o$-100 Sh/100V Toe) (+) | (−) | Relative Average Contrast (+) | (−) | Contrast Differential |
|---|---|---|---|---|---|
| 3A | 21,160/144 | 320/100* | 1.10 | 1.98 | 0.88 |
| 3B | 1,480/23 | 252/104 | 0.76 | 2.60 | 1.84 |
| 3C | 41,800/240 | 420/80 | 1.14 | 1.39 | 0.25 |
| 3D | 1,640/28 | 228/100 | 0.74 | 2.79 | 2.05 |

*assigned a value of 100

EXAMPLE 4

In homogeneous, non-aggregate photoconductive insulating compositions, the contrast-control additives can lower overall contrast, both positive and negative, to exend exposure latitude.

Two photoconductive insulating compositions (4A and 4B) were prepared as follows:

4A — 75 parts by weight of polyester binder (Vitel PE-101), 25 parts by weight of the control photoconductor of Example 1 and 1 part by weight of the sensitizing dye 2,6-bis(4-ethoxyphenyl)-4-(4-pentyloxyphenyl)thiapyrylium perchlorate were dissolved in tichloromethane.

4B — As 4A, except 20 parts photoconductor and 5 parts by weight of 1,3,5-tripiperidinobenzene Electrophotographic elements using the compositions 4A and 4B were prepared and tested as described in Example 1, with the following results.

| Element | Relative Electrical H and D Speed $V_o$-100 Sh/100V Toe (+) | (−) | Relative Average Contrast (+) | (−) |
|---|---|---|---|---|
| 4A | 450/45 | 400/25 | 1.0 | 0.83 |
| 4B | 120/3.6 | 120/3.2 | 0.66 | 0.64 |

EXAMPLE 5

An aggregate photoconductive insulating composition was prepared as described in Example 1. To four portions (5A–5D) of this composition were added contrast modifying additives as follows:

5A — 1,3,5-tripiperidinobenzene (30%)
5B — 1,3,5-tris(4-methylpiperidino)benzene (30%)
5C — 1,3,5-tripiperidinobenzene (40%)
5D — 1,3,5-tris(4-methylpiperidino)benzene (40%)

Electrophotographic elements using compositions 5A–5D were prepared and tested as in Example 1, with the following results:

| Element | Relative Electrical H-D Speed $V_o$-100 Sh/100V Toe (+) | (−) | Relative Average Contrast (+) | (−) | Contrast Differential |
|---|---|---|---|---|---|
| 5A | 750/100* | 1500/875 | 1.14 | 4.27 | 3.13 |
| 5B | 875/94 | 1562/1000 | 1.03 | 5.15 | 4.12 |
| 5C | 750/81 | 1875/1125 | 1.04 | 4.50 | 3.46 |
| 5D | 687/125 | 2188/1250 | 1.50 | 4.11 | 2.61 |

*assigned a value of 100

EXAMPLE 6

An aggregate photoconductive insulating composition is prepared as in Example 1, To eight portions of this composition, (6A–6H) are added one or more of the following materials:

a. Photoconductor - 4,4′-bis(diethylamino)-2,2′-dimethyltriphenylmethane
b. Contrast-modifying agent - 1,3,5-tripiperidinobenzene
c. Photoconductor 4,4′-Bis(diethylamino)tetra phenylmethane
d. Photoconductor: tri-p-tolylamine as follows:
6A — 40% (a)
6B — 30% (b)
6C —
40% (b)
6D — 30%(a) + 10% (b) 6E — 40%(c)
6F — 30%(c) + 10% (b)
6G — 40% (d)
6H — 30%(d) + 10%(b)

Electrophotographic elements using compositions 6A - 6H were prepared as described in Example 1. Each element was then rapidly cycled between charging ($V_o$~600 volts) and photodischarging (3 seconds) one hundred times. After this cycle sequence, a substantial decrease in chargeability is noted in those elements containing contrast modifying agent (b), either alone with the aggregate photoconductor or together with other non-aggregate photoconductors. The results are summarized as follows:

| Element | $\Delta V_1$* 100 Cycle Regeneration (+) | (−) |
|---|---|---|
| 6A | 15 rise | 55 |
| 6B | 415 | 500 |
| 6C | 305 | 375 |
| 6D | 210 | 250 |
| 6E | 15 rise | 40 |

-continued

| Element | $\Delta V_1$* 100 Cycle Regeneration (+) | (−) |
|---|---|---|
| 6F | 165 | 375 |
| 6G | 15 | 85 |
| 6H | 210 | 360 |

*Defined as the drop in voltage from the initial 600-volt surface potential in the shoulder region of an electrical H and D curve. This, therefore, is a measure of layer chargeability.

The high $\Delta V_1$ exhibited by the elements including a charge-modifying agent indicates persistent conductivity, which can be useful in single- and multiple-copy imaging, such as by postponed charging and development for single copy applications or by prompt, repeated charging and development without multiple exposures, for multiple copy applications.

The invention has been described in detail with particular reference to certain preferred embodiments thereof, but it will be understood that variations and modifications can be effected within the spirit and scope of the invention.

There is claimed:

1. An organic photoconductive insulating composiston comprising at least one organic photoconductor and, as a contrast-modifying agent, a compound having the formula:

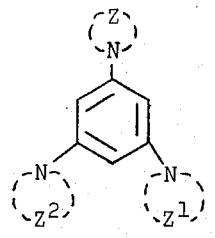

wherein each of Z, $Z^1$ and $Z^2$, taken together with the nitrogen to which each is attached, represents the nonmetallic atoms necessary to complete an N-deterocyclic group having from 5 to 10 atoms in the cyclic nucleus.

2. A photoconductive composition as defined in claim 1, wherein the heterocyclic group completed by atoms represented by each of Z, $Z^1$ and $Z^2$ taken together with the nitrogen atom to which each is attached, has a piperidine nucleus.

3. A photoconductive composition as defined in claim 1 and further comprising an electrically insulating polymeric binder.

4. A photoconductive composition as defined in claim 1 and further comprising a sensitizer for the photoconductor.

5. A photoconductive composition as described in claim 1, wherein the photoconductive compositions comprises an aggregate insulating composition comprising a particulate, co-crystalline complex of (1) a dye salt selected from the group consisting of pyrylium, thiapyrylium and selenapyrylium dye salts and (2) a polymer having an alkylidene diarylene moiety in a recurring unit thereof.

6. A photoconductive composition as described in claim 1 wherein the compound of the formula is present in the composition in an amount of from about 5% by weight to about 50% by weight, based on the total weight of photoconductor in the composition.

7. An organic photoconductive insulating composition comprising at least one organic photoconductor and a 1,3,5-tripiperidinobenzene compound.

8. A photoconductive composition as defined in claim 7 wherein said benzene compound is 1,3,5-tripiperidinobenzene or 1,3,5-tris(4-methylpiperidino)benzene.

9. An organic photoconductive insulating composition comprising (a) an aggregate, photoconductive insulating composition comprising a continuous, electrically insulating binder phase having dispersed therein a particulate, co-crystalline complex of (1) a dye salt selected from the group consisting of pyrylium, thiapyrylium and selenapyrylium dye salts and (2) a polymer having an alkylidene diarylene moiety in a recurring unit thereof and (b) a 1,3,5-tripiperidinobenzene compound.

10. A photoconductive composition as defined in claim 9 wherein said dye salt is a 2,4,6-substituted thiapyrylium dye salt.

11. A photoconductive composition as defined in claim 9 wherein said benzene compound is 1,3,5-tripiperidinobenzene or 1,3,5-tris(4-methyl piperidino)benzene.

12. A photoconductive composition as defined in claim 9 wherein the polymer component of said co-crystalline complex is a carbonate polymer.

13. An organic photoconductive insulating composition comprising (a) at least one organic photoconductor selected from the group consisting of polyarylalkane photoconductors, arylamine photoconductors and aggregate photoconductive compositions comprising a particulate, co-crystalline complex of (1) a dye salt selected from the group consisting of pyrylium, thiapyrylium and selenapayrylium dye salts and (2) a polymer having an alkylidene diarylene moiety in a recurring unit thereof and (b) a compound selected from the group consisting of 1,3,5-tripiperidinobenzene and 1,3,5-tris(4-methylpiperidino) benzene.

14. In an organic electrophotographic element comprising an electrically conductive support bearing an organic, photoconductive insulating layer, the improvement wherein said organic photoconductive insulating layer comprises a photoconductive composition as defined in claim 1.

15. In an organic electrophotographic element comprising an electrically conductive support bearing an organic, photoconductive insulating layer, the improvement wherein said organic photoconductive insulating layer comprises a photoconductive composition as defined in claim 9.

16. In an electrophotographic process wherein an electrostatic charge pattern is formed on an electrophotographic element comprising an electrically conducting support bearing a layer comprising an organic photoconductive insulating composition, the improvement comprising having, as said photoconductive composition, at least one organic photoconductor and a compound having the formula

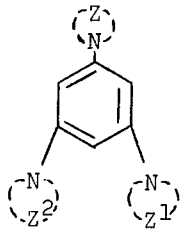

wherein each of Z, $Z^1$ and $Z^2$, taken together with the nitrogen to which each is attached, represents the nonmetallic atoms necessary to complete an N-heterocyclic group having from 5 to 10 atoms in the cyclic nucleus.

* * * * *